United States Patent [19]

Otis et al.

[11] 4,190,013

[45] Feb. 26, 1980

[54] FLOATING DRY STORAGE FACILITY FOR SMALL BOATS

[76] Inventors: Roger W. Otis; Stephen H. Otis, both of P.O. Box 518, McAlester, Okla. 74501

[21] Appl. No.: 873,313

[22] Filed: Jan. 30, 1978

Related U.S. Application Data

[63] Continuation-in-part of Ser. No. 780,236, Mar. 22, 1977, Pat. No. 4,070,979.

[51] Int. Cl.[2] ..... B63B 35/44

[52] U.S. Cl. ..... 114/263; 114/267; 414/253; 414/264; 414/269; 414/279

[58] Field of Search ..... 114/264, 266, 263, 258, 114/259, 267; 214/16.4 B, 16.4 A; 52/29, 167, 650, 665; 414/253, 264, 269, 279

[56] References Cited

U.S. PATENT DOCUMENTS

| | | | |
|---|---|---|---|
| 1,871,475 | 8/1932 | Smith | 114/263 |
| 3,053,216 | 9/1962 | Benson, Jr. | 114/263 |
| 3,166,037 | 1/1965 | Otis | 114/267 |
| 3,189,198 | 6/1965 | Filak | 214/16.4 B |

*Primary Examiner*—Sherman D. Basinger
*Attorney, Agent, or Firm*—Larry B. Dwight

[57] ABSTRACT

A floating storage facility for storing small boats not greater than a predetermined length. A floor system comprising a network of longitudinal and lateral support members disposed over flotation blocks provides support for the building. A pair of spaced parallel weight supporting beams are disposed centrally over the flotation members on each side of the storage facility. The parallel beams support a plurality of columns which support a pair of parallel spaced crane runway rails disposed along the upper portion of the building. The weight of the building is distributed over the flotation device to provide a central stabilized loading point for the building. The building has a lightweight metal frame cover disposed overwardly with the outer walls.

15 Claims, 13 Drawing Figures

FLOATING DRY STORAGE FACILITY FOR SMALL BOATS

CROSS-REFERENCE TO RELATED APPLICATIONS

This is a continuation-in-part application of copending application, Ser. No. 780,236, filed Mar. 22, 1977, now U.S. Pat. No. 4,070,979 issued Jan. 31, 1978.

BACKGROUND

Many of the lakes and reservoirs around the country such as those constructed by the Corps of Engineers, Department of the Army, require boat storage facilities to be floating because of the fluctuating surface level of the water. Because of the rise in popularity of boating sports and the population the number of desirable locations on many of the lakes and reservoirs for positioning boat storage facilities on the surface of the water are becoming less numerous. Heretofore, floating storage facilities have been of the type similar to that disclosed in the patent to R. H. Otis, U.S. Pat. No. 3,166,037. These types of facilities are limited to single slips on one level to store the boat. This requires a large area to store numerous boats and such areas are becoming more valuable and harder to find.

In addition to a decreasing number of areas where it is desirable to store boats out of the rough, open water areas, it is undesirable to maintain the boat in the water year around because of deterioration of the boat hull and the possibility of loss from storms and casualties.

Heretofore, dry storage facilities have been limited to land based facilities such as that disclosed in the patent to Filak U.S. Pat. No. 3,189,198 which facility is constructed on land and extends on piers a small distance over the water to remove the boat from the water. The boats are removed and stored over land with a hoist type device. A fixed permanent storage facility is not suitable for use on certain lakes as heretofore mentioned and does not compensate for the levels of the water should the level drop or rise drastically. This often occurs on flood control type reservoirs where water must be released or stored during flood conditions.

The dry storage facilities which utilize land adjacent the water edge are constructed somewhat differently from that of floating device since the land based facilities must account for earth vibrations such as earthquake conditions when utilizing a multi-level storage facility such as this. These devices often times have separate support members for supporting the boat and support members for supporting the building to prevent undue stresses on the light building members which must be used.

SUMMARY

I have devised a floating dry storage facility for storing boats of a predetermined length. The boats are removed from the water and stored above a platform that is on the water such that as the water surface level varies on the reservoir, the platform will rise or fall with the surface.

The platform generally comprises a network of lateral base supports disposed in a horizontal plane. Flotation members are positioned down each side of the platform in a spaced parallel arrangement. Flotation retaining members are secured about the flotation members to retain them under the platform network. Walkways are constructed within the building and a pair of spaced longitudinal base supports are disposed centrally over each of the spaced parallel arrangements of the flotation members. These longitudinal base supports support a plurality of vertical columns which support a pair of spaced parallel crane runway rails.

A bridge is moveably secured transversely between the pair of spaced parallel crane runway rails and adapted to move longitudinally through the building. The bridge supports a crane having a downwardly extending mast which is rotatably secured to the bridge and adapted to move about a complete circle. The crane mast supports a moveable pair of outwardly extending parallel members adapted to move under the boat hull and lift the boat out of the body of water.

A second set of vertical columns are arranged a predetermined distance outwardly from a first set of vertical columns over the longitudinal base supports and are supported by the platform network.

Roof girders and trusses are supported over the crane runway rails and vertical inner columns to cover the building. A boat slip is formed in the ends of the building to provide an area to which the boat may be moored while waiting to be picked up out of the water. The boats may be positioned in this area when being taken out for use.

The building is constructed to withstand stresses by securing each of the joints in the platform and columns and beams with a bolt type construction allowing a certain degree of flexibility of the building to prevent structural failure of any member.

A second embodiment of the building has upwardly extending members secured along the platform over the longitudinal base supports. Trusses are secured transversely to the longitudinal base supports to form the platform and flotation members are secured between the trusses. Outer wall support members are secured to and extend upwardly from the platform to the roof trusses. Adjustable boat racks are positioned between the upwardly extending members and outer wall support members.

A primary object of the invention is to provide a floating dry boat storage facility for storing small boats of a predetermined length over water surfaces in harbor areas without occupying land lying along the water's edge.

A still further object of the invention is to provide a multi-level storage facility capable of floating with the surface levels of the water on reservoirs where the surface levels vary extensively.

A still further object of the invention is to provide a dry storage facility over the surface of the water for small boats to eliminate the problems encountered in wet storage of the boat and the necessity of utilizing a trailer to transport the boat to and from the water reservoir.

Other and further objects of the invention will become apparent upon studying the detailed specification hereinafter following and drawings annexed hereto.

BRIEF DESCRIPTION OF THE DRAWINGS

Drawings of three embodiments of the invention are annexed hereto so that the invention may be more fully understood, in which.

DESCRIPTION OF A PREFERRED EMBODIMENT

Figure 1:
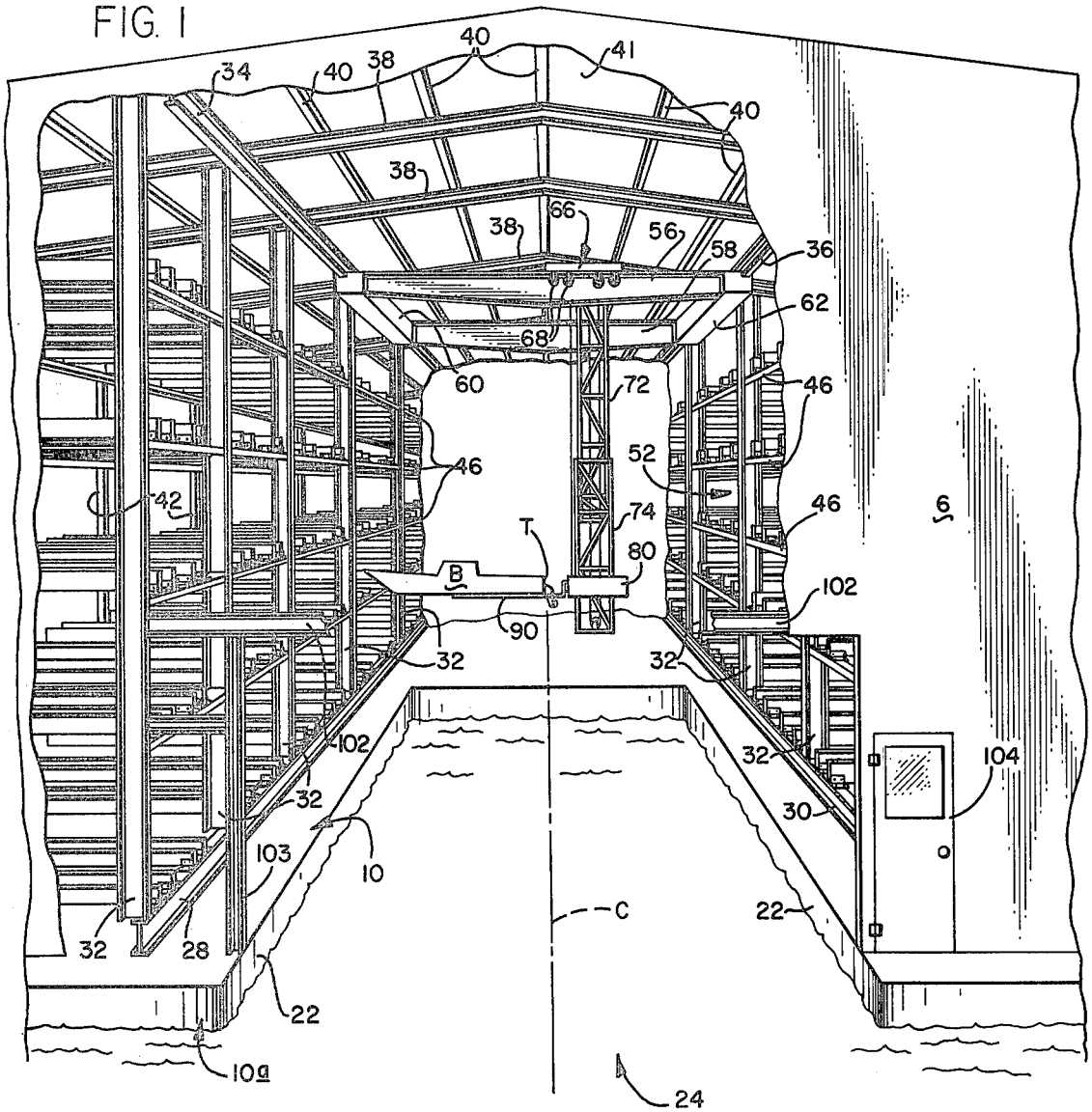
FIG. 1 is a front perspective view showing the floating dry storage facility with parts broken away to more clearly illustrate the details of construction.
Figure 4:
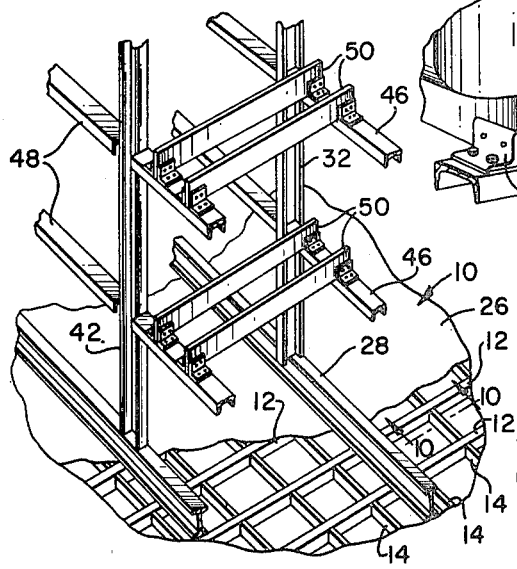
FIG. 4 is an enlarged perspective view of the floor support system.
Figure 10:
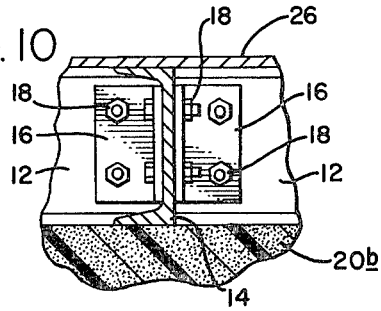
FIG. 10 is a cross-sectional view taken along line 10—10 of FIG. 4.

Referring to FIGS. 1 and 4 of the drawings, the dry storage facility generally comprises a platform 10 adapted to support the building structure. The building platform 10 generally comprises a network of horizontally disposed joists 12 running transversely across the building from front 10*a* to back 10*b*. Connecting members 14 are positioned between joists 12 longitudinally in the building. The joists 12 are connected to connecting members 14 (FIG. 10) by angle brackets 16 which are secured by fasteners such as bolts 18.

Flotation means 20*a* and 20*b* are disposed under the platform 10 and secured by carriage bolts or other suitable means to the network of joists 12 and connecting member 14 as will be more fully described hereinafter.

Means to retain the flotation means under platform 10 comprises a flange member 22 secured about the outer edge of the platform 10. A boat slip opening 24 is formed in each end 10*a* and 10*b* of the platform to receive small boats B and suitable means to moor the boats are provided. A floor cover 26 such as sheet steel or wood is positioned over the platform 10.

Figure 8:
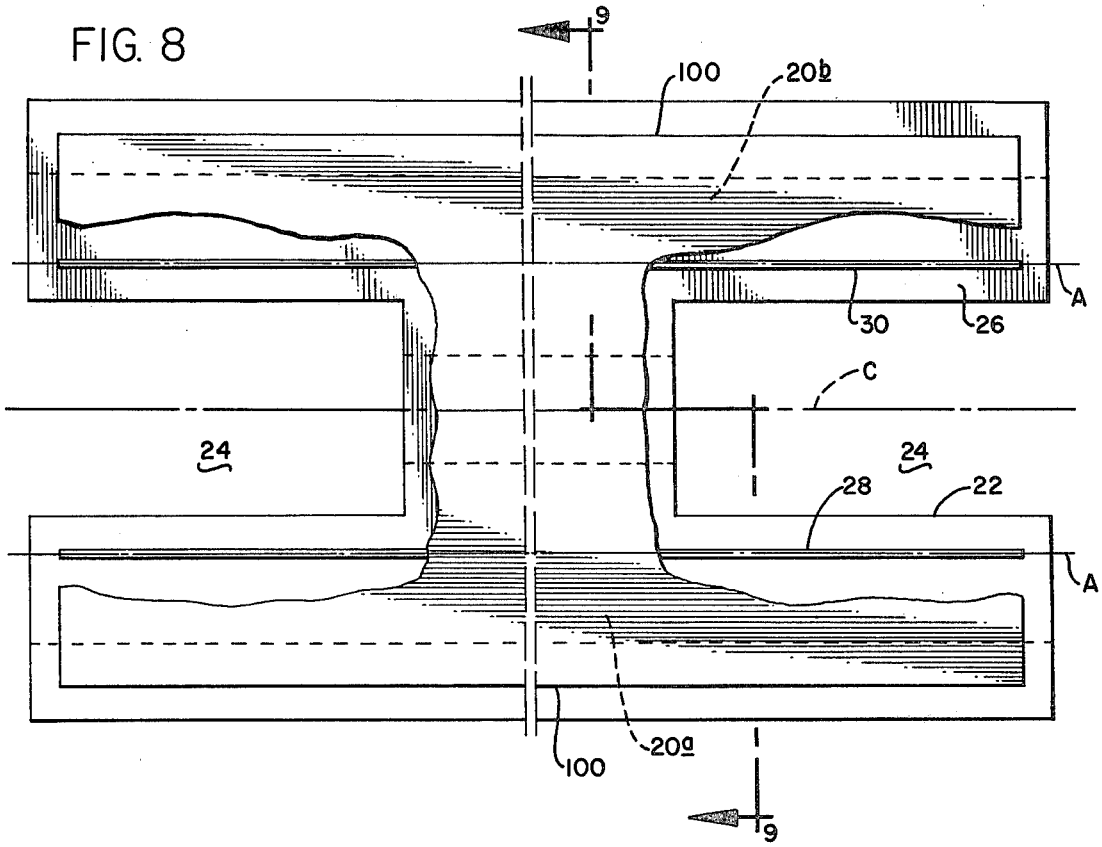
FIG. 8 is a top plan view of the building.
Figure 9:
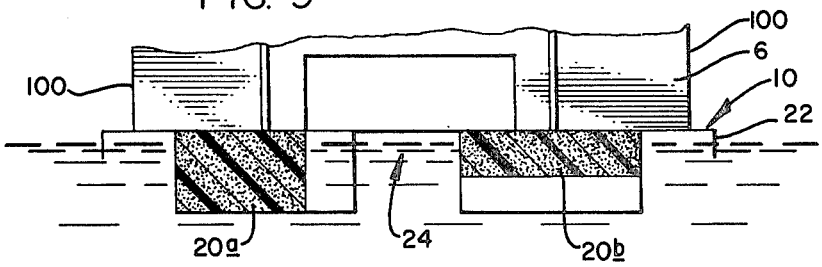
FIG. 9 is a cross-sectional view taken along line 9—9 of FIG. 8.

Flotation means 20*a* and 20*b* generally comprises large blocks of polystyrene plastic such as Styrofoam, manufactured by Dow Chemical Company and comprises small beads of polystyrene inflated with air. The flotation means 20*a* and 20*b* are positioned in two parallel rows along the longitudinal length of the building on each side thereof as illustrated in FIGS. 8 and 9. To determine the amount of polystyrene plastic blocks needed to float the building, the total weight of the building structure is computed along with the maximum load to be hald by the building. The total weight of the building and load is divided by the weight of one cubic feet of water (approximately 62.4 pounds) and this will equal the volume in cubic feet of polystyrene plastic needed to float the building. Flotation means could be ballast tanks or other type flotation devices or material.

For example, a building 281 feet long, 87 feet wide, and 45 feet high in the center with boats may weigh 2.56 million pounds. This includes a 50 pound per square foot live deck load and 30 pounds per square foot live roof load. If you divide the weight of the building $2.56\times10^6$ pounds by the weight of water 62.4 pounds per cubic feet, then you must displace 41,025.64 cubic feet of water with an equal volume of flotation means 20*a* and 20*b*. This means each side of flotation means 20*a* and 20*b* is approximately 24 feet wide and 4 feet deep and is disposed along the 281 foot length of the building.

A pair of spaced parallel support beams 28 and 30 are positioned on each side of slip openings 24 over the center line A of the two rows of polystyrene plastic flotation means 20*a* and 20*b* to provide a rigid support for the building. A plurality of vertically extending spaced columns 32 are secured and extend upwardly from the support beams 28 and 30 along the length of the building. The upper end of the columns 32 are secured to roof trusses 38. A pair of spaced parallel crane support rails 34 and 36 which run longitudinally through the length of the building are secured to by roof girders 38 adjacent said columns 32.

Roof girders 38 are secured to each of the columns 32 and outer columns 42 and 44 to provide support for the roof structure. Spaced purlins 40 extend longitudinally through the building to provide further support for the roof cover 41 such as sheet metal or the like.

Figure 5:
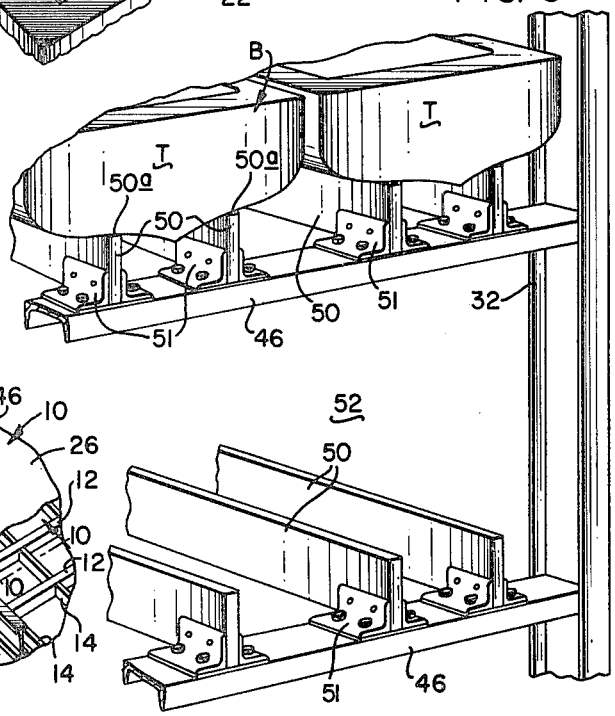
FIG. 5 is an enlarged perspective view of the boat support members.

A second set of outer support columns 42 and 44 are positioned in spaced relationship to each row of columns 32 are secured to and extend upwardly from a support beam secured to transverse joists 12 of the platform 10 to roof girders 38. Columns 42 and 44 provide support for the front portion of boats B. Vertically spaced horizontally extending boat support members 46 and 48 (FIGS. 1, 4 and 5) extend longitudinally through the building and are secured to inner columns 32 and outer columns 42 and 44 respectively. Spaced parallel boat hull supports 50 (FIGS. 4 and 5) extend between boat support members 46 and 48 on each side of the building and are secured thereto by brackets 51, bolts, or otherwise secured to members 46 and 48. Since between 75 to 80% of the total weight of the boat B is positioned in the transom portion of the boat most of the structural strength of the building is centered over beams 28 and 30 which are aligned with the transom of the boat since the front portion of the boat B extends outwardly from the center line C of the building. It should be readily apparent that it is desirable to have the outer columns 42 and 44 aligned with each of the inner columns 32 in a transverse manner to provide individual compartments 52 for storage of one or more boats of a predetermined length.

Figure 6:
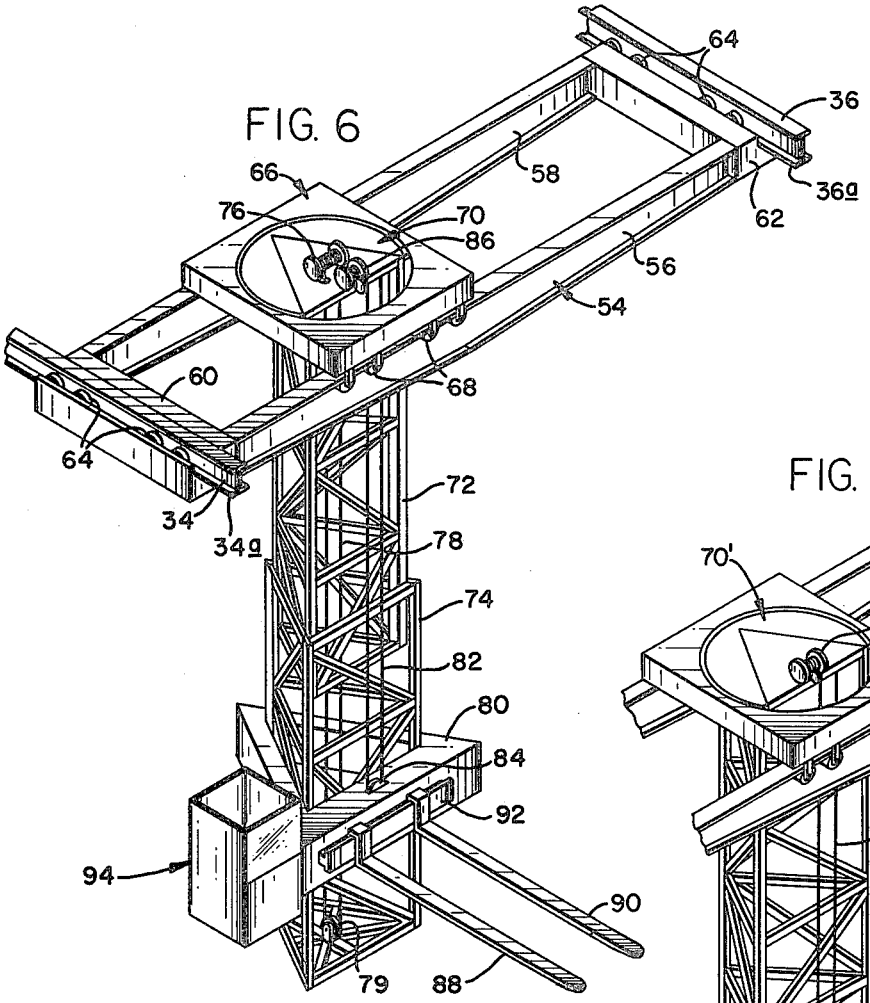
FIG. 6 is a perspective view of the crane system.

Means to transport the boats into and out of the water comprises a crane support bridge 54 (FIGS. 1 and 6). Crane support bridge 54 comprises a pair of spaced parallel girders 56 and 58 secured to end members 60 and 62. Rollers 64 are rotatably secured to each end member 60 and 62 and adapted to engage the lower flange 34*a* and 36*a* of rails 34 and 36. Suitable means to rotate rollers 64 (not shown) to move the crane bridge 64 longitudinally along rails 34 and 36 is provided such as hydraulic or electric motors. A crane truck 66, comprising a platform, is moveably supported over parallel spaced girders 56 and 58 by rollers 68. Suitable drive means (not shown) is provided to move truck 66 between end members 62 and end member 60 between rails 34 and 36. A turntable 70 is rotatably supported by truck 66 and has suitable means to rotate same relative to truck 66. A downwardly depending mast 72 is secured at the upper end of turntable 70, allowing full rotation of the mast 72 relative to truck 66 and transverse movement by truck 66 and longitudinal movement relative to the building by bridge 54. A telescoping mast 74 is slideably disposed over mast 72 to allow vertical movement relative to mast 72. Suitable means such as cable 78 having one end secured to turntable 70 and routed around pulley 79 and onto winch 76 is provided for moving telescoping mast 74 relative to mast 72. A horizontally disposed platform 80 is slideably disposed over the telescopic mast 74 to allow movement of platform 80 relative to a longitudinal axis of telescopic mast 74. Means to move platform 80 comprises a cable 82 having a first end secured to turntable 70 and routed about pulley 84 and to winch 86 on platform 70 for movement of platform 80 vertically. A pair of spaced parallel tines 88 and 90 are moveably secured on tine support member 92. Tines 88 and 90 may be adjusted outwardly for different widths of boats. The tines 88 and 90 are adapted to a position below the water and extend under the boat from the transom T along toward the bow of the boat thus positioning the weight of the boat on the rear portion of the tines 88 and 90 toward platform 80. Platform 80 and telescopic mast 74 are then raised upwardly to lift the boat out of the water or lowered to put the boat into the water. A housing 94 is provided for the operator and suitable hydraulic controls (not shown) are provided to drive the various hydraulic or electrical motors of the crane.

Figure 2:
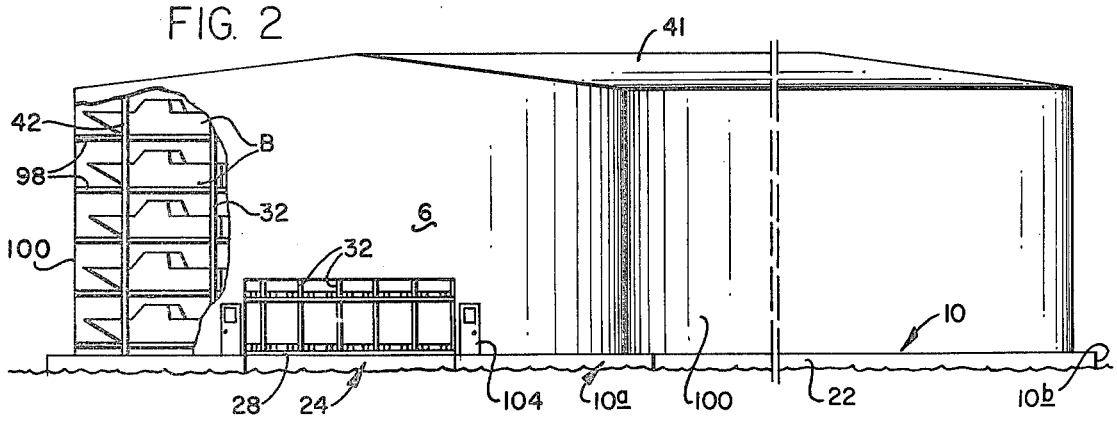
FIG. 2 is a right side, front perspective view of the building with parts broken away.
Figure 3:
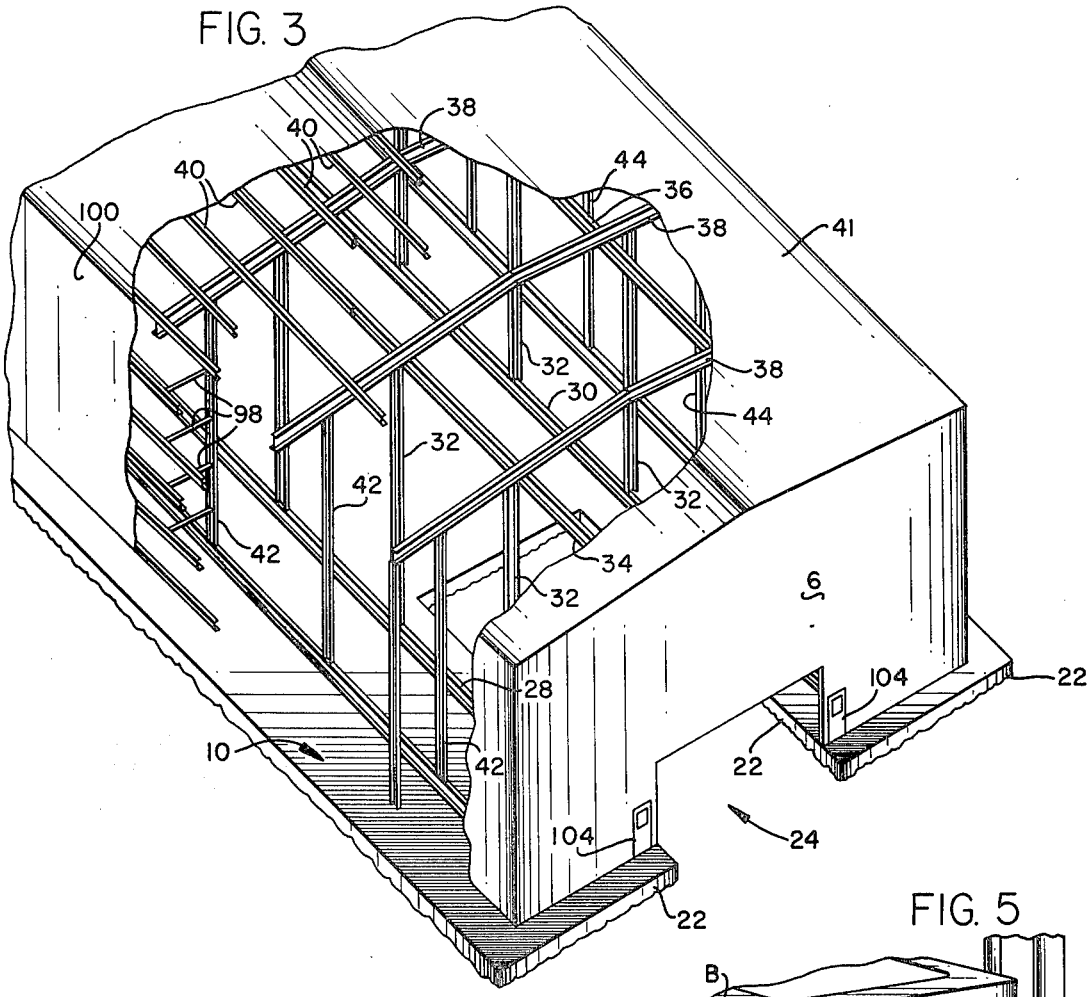
FIG. 3 is a top front perspective view with parts broken away to more clearly illustrate the details of construction.

As best illustrated in FIGS. 2 and 3, cantilever support members 98 extend outwardly from outer columns 42 and 44 to support the outer building walls 100 thus loading the columns 42 and 44 further which are positioned over the flotation means 20 on each side to reduce the amount of flotation required to balance the weight of the building.

The front 6 and back are supported by cross members 102 and studs 103. Front 6 is a sheet metal cover having doors 104 where needed.

Operation of the hereinbefore described invention is as follows:

To place a boat B in storage, the boat is moored in slip opening 24 by the owner or operator of the boat until the crane can be positioned adjacent the vicinity of the boat B. The operator then maneuvers the crane by controlling lateral movement of bridge 54, truck 66 and turntable 70 and vertical movement of telescoping mast 74 and platform 80 to position the tines 88 and 90 under the transom T of the boat B. The operator moves the tines 88 and 90 forward under the transom T of the boat B adjacent, but spaced from the bottom hull of the boat B. The operator lifts the boat B vertically out of the water by movement of platform 80 and telescopic mast 74 upwardly. Truck 66 is then centered relative to bridge 54, and bridge 54 is moved along until it is adjacent a compartment 52 which is vacant. The turntable 70 is then rotated to bring the boat about 90 degrees such that the bow of the boat is pointed outwardly of the centerline C of the building and the longitudinal axis of the boat is transverse to the longitudinal axis C of the building. The boat B is centered over the spaced parallel boat support members 50 and truck 66 is moved toward the compartment 52 to insert the boat B into the compartment 52. The tines 88 and 90 are then lowered positioning the transom T of the boat B adjacent the boat support 46 on the inner columns 32 and the hull onto boat hull supports 50. The tines 88 and 90 are further lowered below the upper surface 50a of supports 50 and truck 66 is reversed to move the tines outwardly of the compartment 52 wherein the boat is stored there until ready for use again. The process is reversed for positioning a boat out of compartment 52 into the body of water.

It should be readily apparent that suitable walkways may be provided within the building and from the building to land areas were desirable or transportation may be provided to and from the shore on larger bodies of water. The building may be anchored by a suitable means such as flexible cables or poles which allow vertical movement of the building relative to the longitudinal axis of the poles.

SECOND EMBODIMENT OF CRANE

Figure 7:
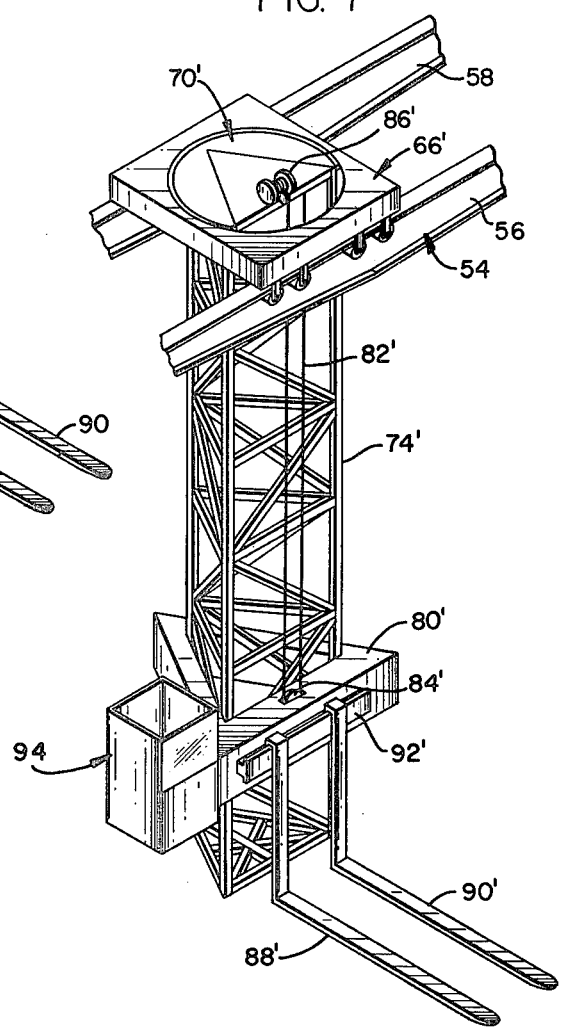
FIG. 7 is a perspective view of the second embodiment of the crane.

FIG. 7 shows a second embodiment of the crane having a fixed downwardly depending mast 74' which extends downwardly to the floor 26 but is spaced therefrom to allow movement of the mast 74' longitudinally through the building. Platform 80' is slideably disposed over the fixed mast 74' and has suitable means for movement of the mast and platform 80' relative to fixed mast 74'. Tines 88' and 90' extend downwardly from tine support member 92' a sufficient distance to allow movement into the water approximately 4 to 6 feet. Tines 88' and 90' then extend in a horizontal plane outwardly therefrom in a manner similar to that in the first embodiment. Winch 86' is secured to cable 82' which are routed around pulley 84' on each end of platform 80' to provide a means to lift the platform 80'. Movement of the crane is similar to that described in the first embodiment. However, platform 80' is the only controllable heighth adjustment and tines 88' and 90' are positioned under the water behind the transom of the boat B and move forward under the boat hull until the transom T is adjacent the platform 80'. The boat B is then lifted out of the water by lifting platform 80' and positioned in a compartment 52 in a manner similar to that previously described.

THIRD EMBODIMENT

Figure 11:
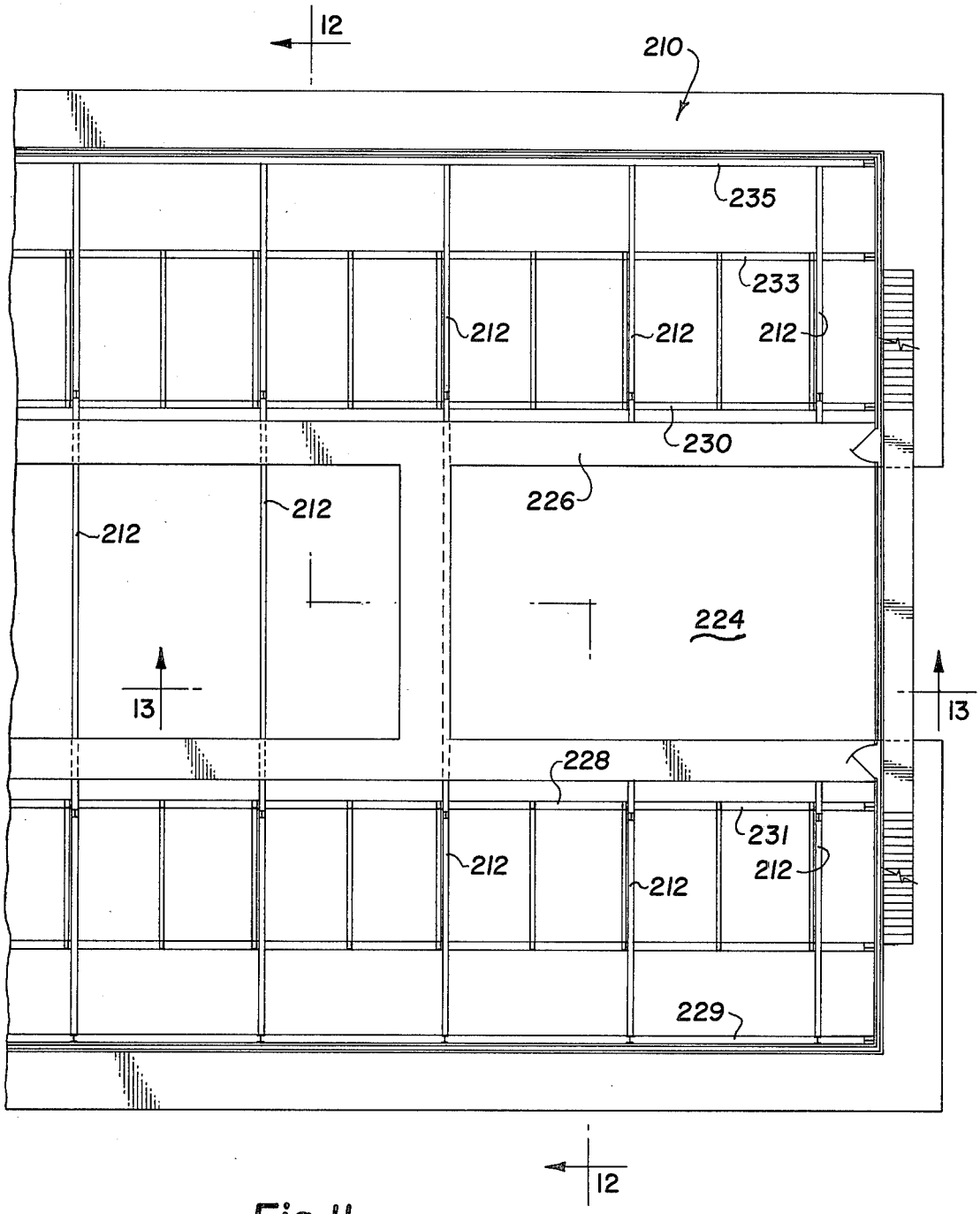
FIG. 11 is a partial plan view of a third embodiment.
Figure 12:
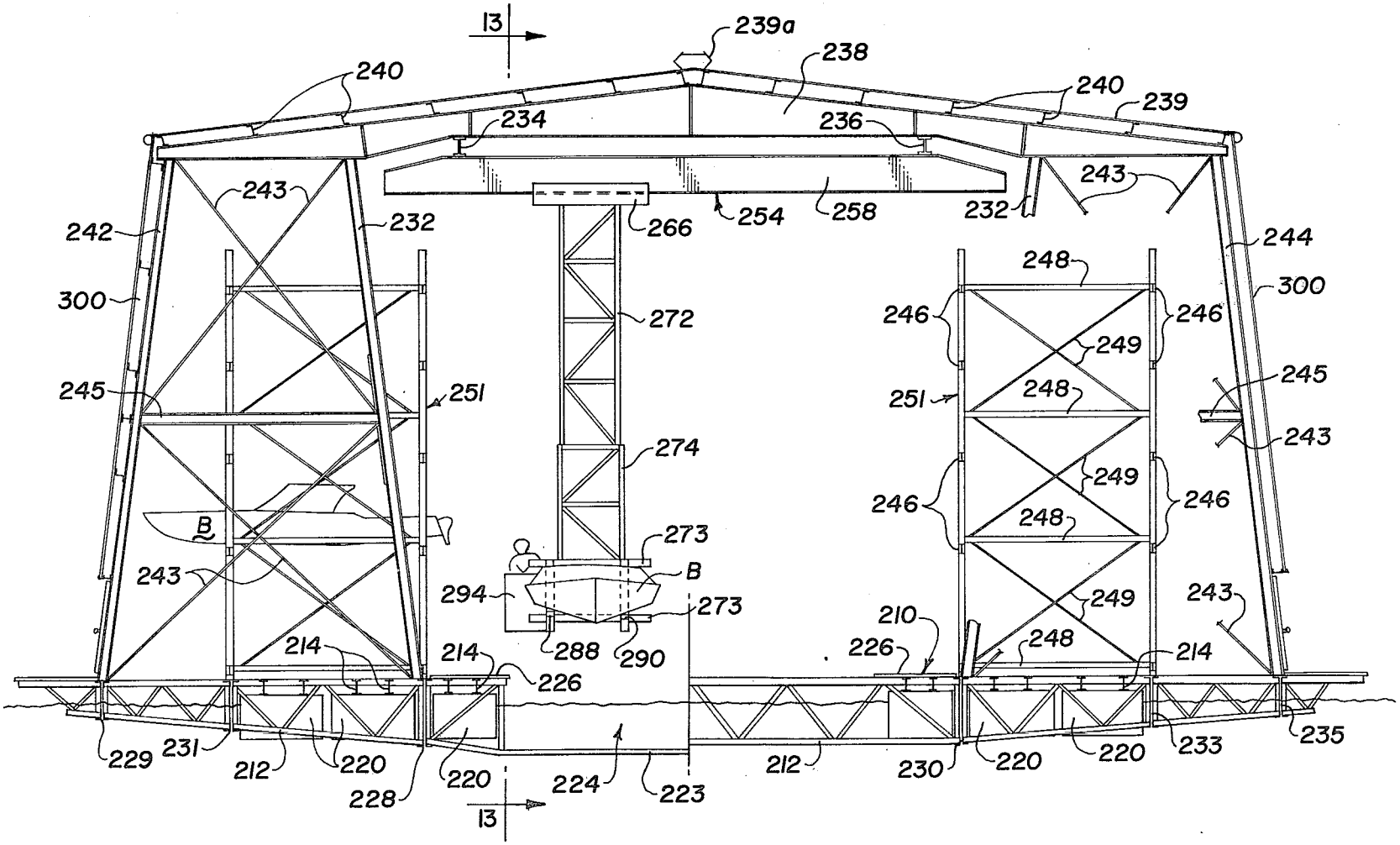
FIG. 12 is a cross-sectional view of the third embodiment of the building taken along cross sectional lines 12—12 in FIG. 11 and with parts broken away to more clearly illustrate the details of construction.
Figure 13:
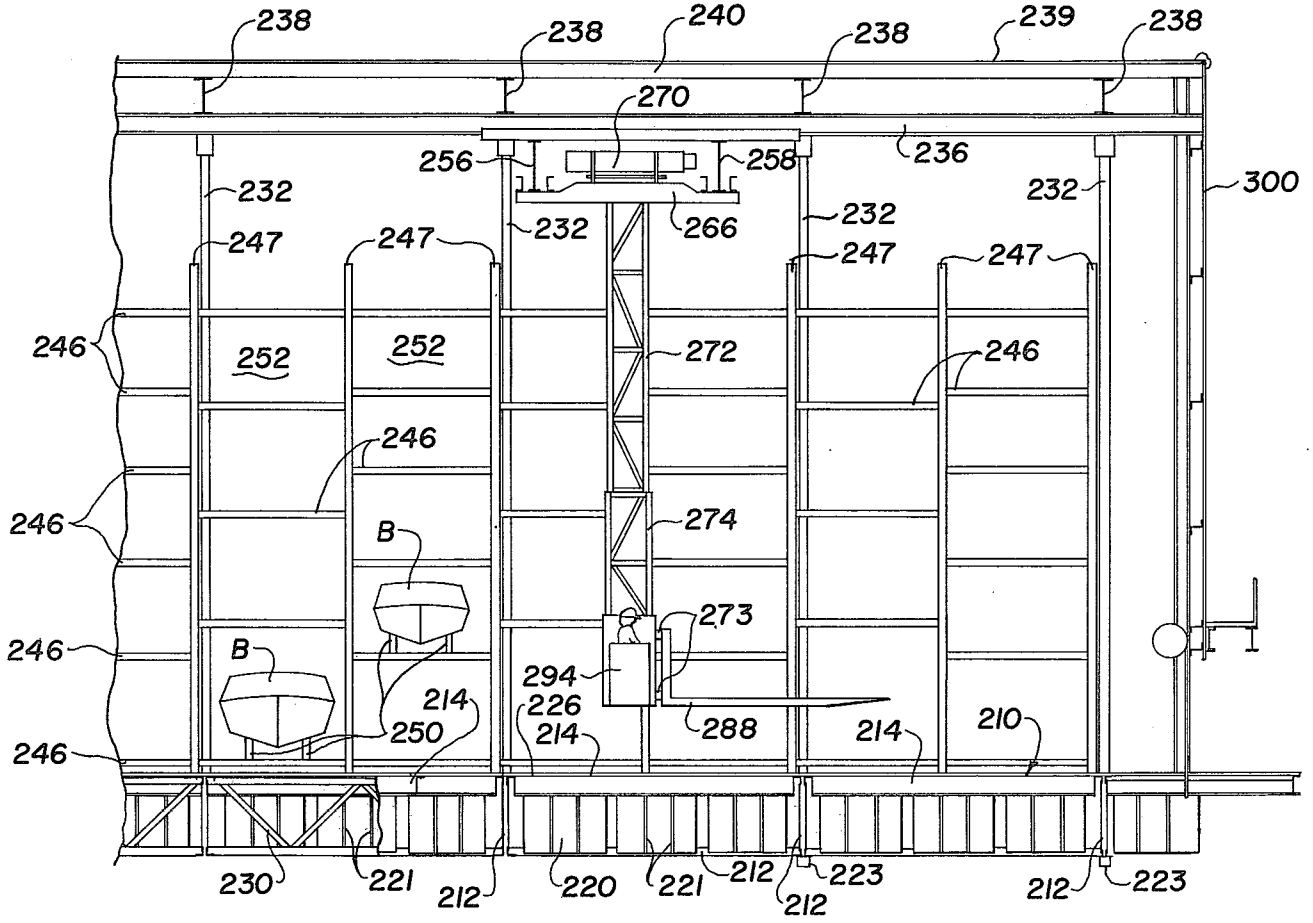
FIG. 13 is a cross-sectional view taken along line 13—13 of FIG. 11 and of FIG. 12.

Referring to FIGS. 11 and 12 of the drawings, an alternate embodiment of the building is illustrated. The platform 210 generally comprises a pair of interiorly positioned trusses 228 and 230 spaced on opposite sides of the slip 224 substantially longitudinally through the building. The outside trusses 229 and 235 run longitudinally along the outside wall of the building. Trusses 231 and 233 are spaced between the inside trusses 228 and 230 and outside trusses 229 and 235 and run substantially longitudinally through the building. Trusses 228 and 230, 229 and 231, 233 and 235 are connected by a plurality of transverse trusses 212 which are tapered on the exterior ends thereof to save material since the majority of the loading is on the interior trusses 228 and 230. The trusses are preferably constructed of aluminum, a non-corroding material, and are of the open web bar joist type trusses. In the area of the slip 224, transverse trusses 212 are omitted between longitudinal trusses 228 and 230 and are connected by connector member 223 which passes under water to prevent spreading of the building within the slip 224 area. Members 223 run substantially under the water to allow boats to move into and out of the slip 224.

Joists 214 run between trusses 212 to support a flooring 226 for walking on.

A plurality of columns 232 are spaced along trusses 228 and 230 and extend upwardly to provide the principal building roof support. As illustrated in FIG. 11, the columns 232 may be inclined toward the outside wall of the building slightly. Outer columns 242 and 244 extend upwardly from trusses 229 and 235 along the outside of the building to provide the outside support from the roof trusses 238. Roof trusses 238 are secured to the upper end of columns 232 and outer columns 242 and 244. The truncated triangular shape formed by columns 232 and 242 and 232 and 244 forms a triangular truss which is braced by crossmember 245 and braces 243 which adds substantial strength of the building. The roof trusses 238 generally comprise I-beams, coated with a moisture proof paint, secured over each set of columns 232 and the outer columns 242 and 244. Perlins 240 are secured, longitudinally relative to the building, over the roof trusses 238 in spaced relationship to support a light weight metal covering 239 such as enamel baked aluminum sheets. A vent 239a is provided along the ridge of the building to ventilate the building.

Boat racks 251 are secured independently of the building columns 232 and 242, and 244 to trusses 230 and 233 on the right side as viewed in FIG. 11 and trusses 228 and 231 on the left side as viewed in FIG. 11. Vertical members 247 are connected by horizontally extending cross members 246 which extend parallel to the longitudinal axis of the building. The inner and outer vertical members 247 are connected by lateral members 248 and braces 249 to add rigidity to the boat support racks 251. The boat racks 251 are preferably adjustable such that the distance between horizontal members 246 may be adjusted to allow for varying heighths of different boats such that the boat stalls 252 may be of varying heights.

Boat support members 250 are secured between the horizontal members 246 to support the boats B as illustrated in FIG. 12.

The means to move the boats B into and out of the stalls 252 and into and out of the water generally comprises a pair of spaced longitudinally extending crane support rails 234 and 236 secured along an upper part of the building such as roof trusses 238. The crane support bridge 254 comprising a pair of I-beams 256 and 258 for supporting truck 266. Downwardly depending mast 272 is secured to a turntable 270 on truck 266 to allow rotation of the mast 272. A telescoping mast 274 is telescopically disposed over downwardly depending mast 272. A pair of spaced parallel tines 288 and 290 may be adjusted outwardly for different widths of boats B and are positioned on members 273 to a telescoping mast 274 and adapted to go below the water surface as the telescoping mast 274 is extended downwardly. The housing 294 is provided to secure the operator close to the boat B being picked up. The embodiment shown in FIG. 6 and in FIG. 7 may be used as the crane for the building in FIG. 12.

Flotation devices 220 generally comprising gasoline retardant foam flotation blocks of polystyrene are secured between the trusses 212 by straps 221 secured to platform 210. The outer walls are covered by a lightweight metal such as aluminum sheets 300 secured to typical support structure well known or in other ways to make the building architecturally sound and desirable. In addition, various walkways around the outside of the building and inside are provided to allow proper operation of maintenance of the building.

It should further be appreciated that crane support rails 234 and 236 may be positioned at other positions in the building and by forming an inverted U-shaped support frame having rollers positioned on the base of the building to roll on guide rails.

By inclining inner columns 232 inwardly this provides an over extension of I-beams 258 and 256 of bridge 254 over the upper portion of the inner columns 247 of boat support racks 251 providing an additional aid in positioning boats B in the boat support racks 251.

Operation of the hereinbefore device is substantially the same as the first embodiment and therefore further discussion is not deemed necessary.

It should be readily apparent that the buildings may be anchored by several methods well known in the art and that piers may be constructed to provide a walkway to land or the persons using same may be ferried to land.

From the foregoing it should be readily apparent that each of the embodiments hereinbefore described accomplishes the objects of the invention.

It should be readily apparent that other and further embodiments of the invention may be devised without departing from the basic concept heretofore disclosed.

Having described our invention, we claim:

1. A floating dry storage facility for removing and storing boats of a maximum predetermined length in a building from a body of water comprising: a plurality of spaced horizontally disposed support members positioned transversely through the length of the building, said support members spanning across the building; longitudinal support means connecting the support members to form a platform; flotation means positioned under each side of said platform between each horizontally disposed support member to equally balance the load of the building and any contents to support said facility in the body of water; a plurality of spaced upwardly extending columns secured along the platform and spaced along each side from the centerline of the platform; roof truss means secured to the upper ends of said columns; a pair of spaced parallel runway rails secured to said roof truss means through said facility; a plurality of outer upwardly extending columns secured along the outer portion of said platform and to said roof truss means, upwardly extending columns said outer being substantially aligned with said columns; boat support means secured to said platform on each side of the building for storing a plurality of boats on a plurality of levels above the platform; bridge means moveably secured between the spaced parallel runway rails; lift means depending downwardly from said bridge means and adapted to raise the lower the boats; and means to cover said facility.

2. The combination called for in claim 1 wherein the flotation means comprises: blocks of polystyrene plastic, said blocks of polystyrene plastic being positioned under said platform in spaced rows extending longitudinally through the building.

3. The combination called for in claim 1 wherein said lift means comprises: a downwardly depending rigid mast secured to said bridge means; a second mast slideably secured to said first mast; and a pair of tines extending outwardly and secured to the lower end of said second mast.

4. The combination called for in claim 3 with the addition of: a horizontally extending platform secured to said second mast, said tines being secured to said horizontally extending platform.

5. The combination called for in claim 1 wherein the lift means comprises: a downwardly depending mast secured to said bridge means; a horizontally extending platform slideably secured to said mast; a pair of tines having a first downwardly depending portion and a horizontally extending portion adapted to move below the surface of the water to lift a boat out of the water.

6. The combination called for in claim 1 with the addition of: a recess formed in the end of said platform for mooring the boats therein.

7. The combination called for in claim 1 wherein said boat support means is independently secured to said platform.

8. The combination called for in claim 1 wherein said boat support means comprises: a plurality of vertical members secured in two rows in spaced relation on each side of the platform; lateral connector members securing the vertical support members, said lateral members being substantially transverse to the longitudinal axis of the building; and adjustable horizontally extending members secured to said vertical members.

9. A floating dry storage facility for removing and storing boats of a maximum predetermined length comprising: a platform having a plurality of spaced horizontal members positioned through the length of the facility and spanning across the facility means connecting said horizontal members; flotation means secured under said platform between the spaced horizontal members to float the platform on the surface of a body of water; a housing secured on said platform; boat storage means secured in said housing for dry storage of the boats on a plurality of levels above the platform; and lift means adapted to move the boats from the body of water to said boat storage means and back again.

10. The combination called for in claim 9 wherein the flotation means comprises: blocks of polystyrene plastic; and means securing said blocks under said platform.

11. The combination called for in claim 9 wherein said housing comprises: a plurality of outer columns secured to and extending upward from said platform; roof support means secured to said columns; and a cover secured over said roof support means and columns.

12. The combination called for in claim 11 wherein said outer columns are inclined inwardly at the upper portion of the building.

13. The combination called for in claim 9 wherein said lift means comprises: a crane guide means positioned through said building; a crane moveably secured to said crane guide means, said crane adapted to lift said boats.

14. A floating dry storage facility for removing and storing boats of a maximum predetermined length in a building from a body of water comprising: a plurality of spaced horizontally disposed support members positioned, transversely through the length of the building said support members spanning across the entire width of the building longitudinal support means connecting the support members to form a platform; flotation means positioned under each side of said platform between each horizontally disposed member to equally balance the load of the building and any contents to support said facility in the body of water; a plurality of spaced upwardly extending columns secured along the platform and spaced along each side from the centerline of the platform; roof truss means secured to the upper ends of said columns; a pair of spaced parallel runway rails secured to said roof truss means through said facility; boat support means secured to said platform on each side of the building for storing a plurality of boats on a plurality of levels above the platform; bridge means moveably secured between the spaced parallel runway rails; lift means depending downwardly from said bridge means and adapted to raise and lower the boats; and means to cover said facility.

15. The combination called for in claim 14 wherein the flotation means comprises: blocks of polystyrene plastic, said blocks of polystyrene plastic being positioned under said platform between the spaced horizontally disposed support members in spaced rows extending longitudinally through the building.

* * * * *

UNITED STATES PATENT AND TRADEMARK OFFICE

CERTIFICATE OF CORRECTION

PATENT NO. : 4,190,013

DATED : February 26, 1980

INVENTOR(S) : Roger W. Otis, et al.

It is certified that error appears in the above-identified patent and that said Letters Patent are hereby corrected as shown below:

In Claim 1, column 8, line 41, after "outer" insert --said outer upwardly extending columns --.

In Claim 9, column 9, line 22, after "facility" insert -- ; --.

In Claim 14, column 10, line 15, after "building", insert -- ; --.

Signed and Sealed this

*First* Day of *July 1980*

[SEAL]

*Attest:*

SIDNEY A. DIAMOND

*Attesting Officer*

*Commissioner of Patents and Trademarks*